US006202610B1

(12) United States Patent
Yoshiki et al.

(10) Patent No.: US 6,202,610 B1
(45) Date of Patent: Mar. 20, 2001

(54) VALVE OPERATING CONTROL SYSTEM FOR INTERNAL COMBUSTION ENGINE

(75) Inventors: Koichi Yoshiki; Keiji Tsujii; Masayuki Wakui, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/497,755

(22) Filed: Feb. 4, 2000

(30) Foreign Application Priority Data

Feb. 5, 1999 (JP) ..... 11-028618

(51) Int. Cl.[7] ..... F01L 13/00

(52) U.S. Cl. ..... 123/90.15; 123/90.16; 123/90.17

(58) Field of Search ..... 123/90.15, 90.16, 123/90.17, 90.18, 90.31

(56) References Cited

U.S. PATENT DOCUMENTS 5,031,583 * 7/1991 Konno ..... 123/90.16
5,497,737 * 3/1996 Nakamura ..... 123/90.15
5,531,193 * 7/1996 Nakamura ..... 123/90.15

FOREIGN PATENT DOCUMENTS 5-43847 7/1993 (JP) .

* cited by examiner

*Primary Examiner*—Wellun Lo
(74) *Attorney, Agent, or Firm*—Arent Fox Kintner Plotkin & Kahn PLLC

(57) ABSTRACT

A valve operating control system for an internal combustion engine is provided which includes a cam switching type first valve operating characteristic changing mechanism, and a cam-phase changing type second valve operating characteristic changing mechanism, wherein the responsiveness and the reliability of the valve operating characteristic changing control can be guaranteed, while suppressing the capacity of an oil pump used commonly for both of the valve operating characteristic changing mechanisms. If the cam phase of the cam-phase changing type second valve operating characteristic changing mechanism is set in a most-retarded state by a second hydraulic pressure control valve when the cam switching type first valve operating characteristic changing mechanism has established a high-speed valve timing by supplying hydraulic pressure from a first hydraulic pressure control valve to the mechanism, the second hydraulic pressure control valve is brought into a neutral state to cut off hydraulic pressure from the oil pump, and an advancing chamber and a retarding chamber in the second valve operating characteristic changing mechanism are closed. Thus, it is possible to prevent the consumption of hydraulic pressure in the second valve operating characteristic changing mechanism to ensure hydraulic pressure supplied to the first valve operating characteristic changing mechanism.

1 Claim, 13 Drawing Sheets

VALVE OPERATING CONTROL SYSTEM FOR INTERNAL COMBUSTION ENGINE

BACKGROUND OF THE INVENTION

1. Field of the Invention

The present invention relates to a valve operating control system for an internal combustion engine, including a cam switching type, first valve operating characteristic changing mechanism, and a cam-phase changing type, second valve operating characteristic changing mechanism.

2. Description of the Prior Art

An internal combustion engine is known from Japanese Patent Publication No. 5-43847, which includes a cam switching type valve operating characteristic changing mechanism for stepwise controlling the valve lift and the opening angle of an intake valve or an exhaust valve for an internal combustion engine, and a cam-phase changing type, valve operating characteristic changing mechanism for continuously controlling the timing of the opening and closing of the valve.

When the cam-phase changing type, valve operating characteristic changing mechanism is mounted in an internal combustion engine including a cam switching type, valve operating characteristic changing mechanism, it is desirable that a common oil pump be used for both of the valve operating characteristic changing mechanisms and the capacity or displacement of the oil pump is suppressed to the minimum, in order to reduce the number of parts and to simplify the structure.

In general, however, the cam switching type valve operating characteristic changing mechanism is constructed to establish a high-speed valve timing by supplying hydraulic pressure from the oil pump, and to establish a low-speed valve timing by cutting-off the supplying of that hydraulic pressure. The cam-phase changing type, valve operating characteristic changing mechanism is constructed to change the cam phase by supplying hydraulic pressure selectively to the advancing chamber or the retarding chamber. If the cam phase is intended to be changed when high-speed valve timing has been established, or if the high-speed valve timing is intended to be established when the cam phase has been changed, there is a possibility that the hydraulic pressure supplied from the oil pump may be insufficient, resulting in a reduction in responsiveness and reliability of the valve operating characteristic changing control.

SUMMARY OF THE INVENTION

The present invention has been accomplished with the above circumstance in view, and it is an object of the present invention to provide a valve operating control system for an internal combustion engine including a cam switching type, valve operating characteristic changing mechanism, and a cam-phase changing type, valve operating characteristic changing mechanism, wherein the responsiveness and the reliability of the valve operating characteristic changing control can be guaranteed, while suppressing the capacity of the oil pump used commonly for both of the valve operating characteristic changing mechanisms.

To achieve the above object, there is provided a valve operating control system for an internal combustion engine, comprising a cam switching type, first valve operating characteristic changing mechanism to which hydraulic pressure is supplied from an oil pump through a first hydraulic pressure control valve, and a cam-phase changing type, second valve operating characteristic changing mechanism to which the hydraulic pressure is supplied from the oil pump through a second hydraulic pressure control valve, the first valve operating characteristic changing mechanism being adapted to select a low-speed cam to establish a low-speed valve timing, when no hydraulic pressure is supplied from the first hydraulic pressure control valve, and to select a high-speed cam to establish a high-speed valve timing, when the hydraulic pressure is supplied. The second valve operating characteristic changing mechanism includes an advancing chamber and a retarding chamber, and is adapted to change the cam phase, when hydraulic pressure is supplied selectively to the advancing chamber or the retarding chamber. When the first valve operating characteristic changing mechanism establishes the high-speed valve timing and the second valve operating characteristic changing mechanism sets the cam phase in a most-displaced basic position, the second hydraulic pressure control valve closes both of the advancing chamber and the retarding chamber, and is maintained in a neutral position in which it cuts off the hydraulic pressure supplied from the oil pump.

With the above arrangement, when the high-speed valve timing is established by supplying hydraulic pressure from the oil pump through the first hydraulic pressure control valve to the cam switching type, first valve operating characteristic changing mechanism, and the cam phase is set in the most-displaced basic position by the cam-phase changing type, second valve operating characteristic changing mechanism, the second hydraulic pressure control valve cuts off the hydraulic pressure supplied from the oil pump to close the advancing chamber and the retarding chamber in the second valve operating characteristic changing mechanism, thereby maintaining the cam phase in the most-displaced basic position. Thus, it is possible to set the cam phase in the most-displaced basic position without consumption of hydraulic pressure supplied from the oil pump by the leakage in the second valve operating characteristic changing mechanism, and to ensure the hydraulic pressure enough for the first valve operating characteristic changing mechanism to establish the high-speed valve timing with the minimum capacity or displacement of the oil pump, thereby guaranteeing the reliability of the valve operating characteristic changing control. Moreover, the second hydraulic pressure control valve is maintained in the neutral position in which it closes the advancing chamber and the retarding chamber in the second valve operating characteristic changing mechanism. Therefore, in changing the cam phase from the most-displaced basic position to an opposite position, the hydraulic pressure supplied to the advancing chamber or the retarding chamber in the second valve operating characteristic changing mechanism can be immediately raised to enhance the responsiveness.

BRIEF DESCRIPTION OF THE DRAWINGS

The mode for carrying out the present invention will now be described by way of an embodiment shown in the accompanying drawings.

FIG. 1 is a perspective view of an internal combustion engine having a valve operating system of the present invention.

FIG. 2 is an enlarged view taken in the direction of arrow 2 in FIG. 1.

FIG. 3 is a sectional view taken along line 3—3 in FIG. 2.

FIG. 4 is a sectional view taken along line 4—4 in FIG. 2.

FIG. 5 is a sectional view taken along line 5—5 in FIG. 3.

FIG. 6 is a sectional view taken along line 6—6 in FIG. 2.

FIG. 7 is a hydraulic pressure circuit diagram of a valve operating characteristic changing mechanism.

FIG. 8 is a vertical sectional view of a second hydraulic pressure control valve.

FIG. 9 is a first portion of a flow chart of a target cam phase calculating routine of the present invention.

FIG. 10 is a second portion of the flow chart of the target cam phase calculating routine.

FIG. 11 is a first portion of a feedback control routine for a second valve operating characteristic changing mechanism of the present invention.

FIG. 12 is a second portion of the feedback control routine for the second valve operating characteristic changing mechanism.

FIG. 13 is a diagram showing a map for searching a water-temperature correcting factor KTWCI based upon a cooling water temperature TW.

FIG. 14 is a diagram showing a map for searching an upper-limit value #DVLMTH2 based upon the cooling water temperature TW or a deviation DCAINCMD.

DETAILED DESCRIPTION OF THE PREFERRED EMBODIMENT

Figure 1:
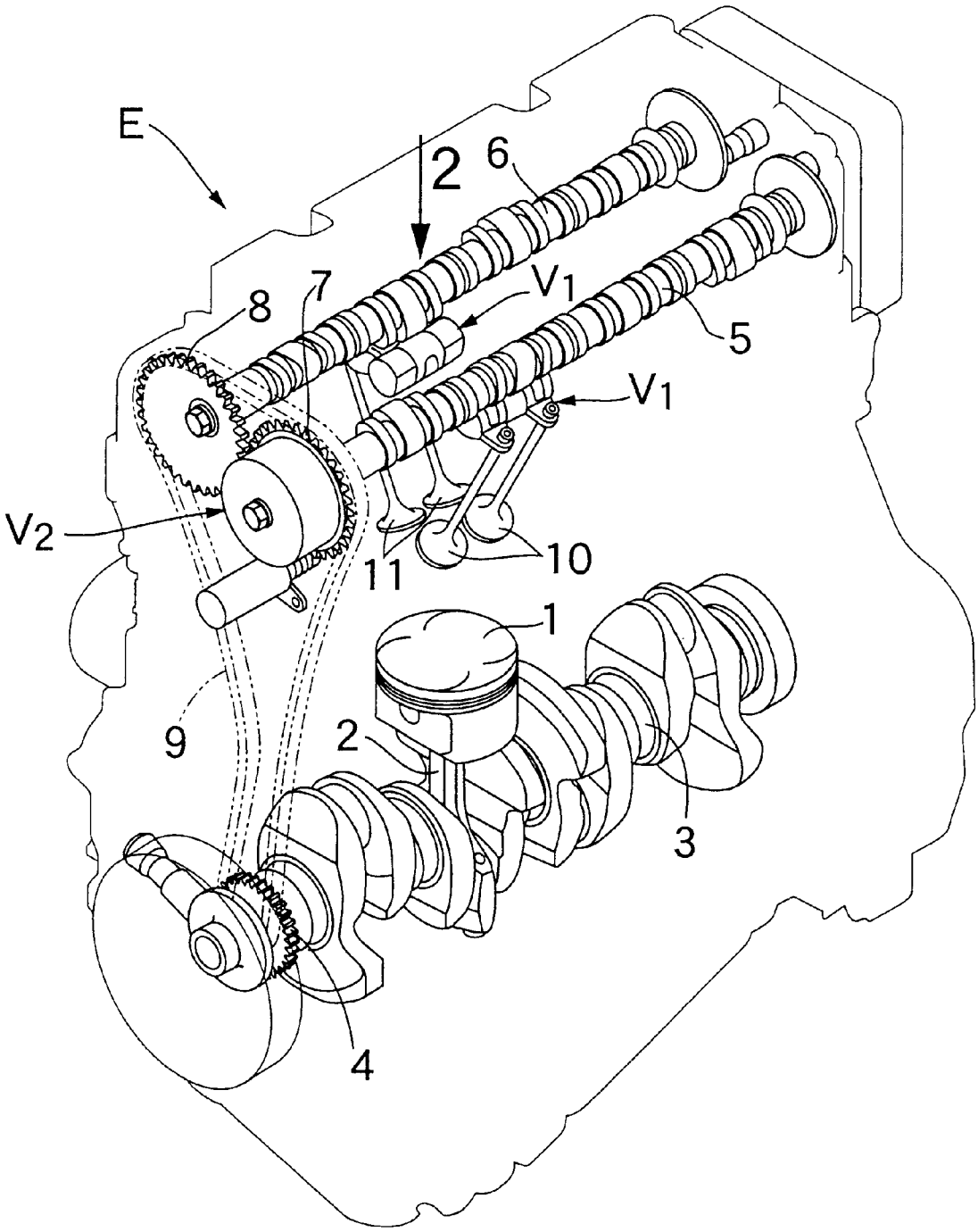
FIGS. 1 to 14 show an embodiment of the present invention.

As shown in FIG. 1, a 4-cylinder DOHC type internal combustion engine E includes a crankshaft 3 to which four pistons 1 are connected through connecting rods 2. A driving sprocket 4 mounted at an end of the crankshaft 3 and follower sprockets 7 and 8 mounted at ends of an intake cam shaft 5 and an exhaust cam shaft 6, respectively, are connected to each other through a timing chain 9, so that the intake cam shaft 5 and the exhaust cam shaft 6 are driven in rotation at a ratio of one rotation per two rotations of the crankshaft 3.

Two intake valves 10, 10 driven by the intake cam 5 and two exhaust valves 11, 11 driven by the exhaust cam shaft 6 are provided for each of four cylinders. First valve operating characteristic changing mechanisms $V_1$, $V_1$ for changing the valve lifts and the opening angles of the intake valves 10, 10 and the exhaust valves 11, 11 at two stages, are provided between the intake cam shaft 5 and the intake valves 10, 10 and between the exhaust cam shaft 6 and the exhaust valves 11, 11, respectively. A second valve operating characteristic changing mechanism $V_2$ is provided at the end of the intake cam shaft 5 for continuously advancing and retarding the opening and closing timing for the intake valves 10, 10.

The first valve operating characteristic changing mechanism $V_1$ for the intake valves 10, 10 and the second valve operating characteristic changing mechanism $V_1$ for the exhaust valves 11, 11 are of substantially the same structure and hence, only the structure of the first valve operating characteristic changing mechanism $V_1$ for the intake valves 10, 10 will be described with reference to FIGS. 2 to 5.

The intake cam shaft 5 is provided with a pair of low-speed cams 14, 14 and a high-speed cam 15 sandwiched between both of the low-speed cams 14, 14 in correspondence to each of the cylinders. A first rocker arm 17, a second rocker arm 18 and a third rocker arm 19 are swingably carried on a rocker shaft 16 fixed in parallel to and below the intake cam 5 in correspondence to the low-speed cam 14, the high-speed cam 15 and the low-speed cam 14, respectively.

Each of the pair of low-speed cams 14, 14 is comprised of a cam lobe $\mathbf{14}_1$ protruding a relatively small amount in the radial direction of the intake cam shaft 5, and a base-circle portion $\mathbf{14}_2$. The high-speed cam 15 is comprised of a cam lobe 151 protruding an amount larger than that of the cam lobes $\mathbf{14}_1$, $\mathbf{14}_1$ of the low-speed cams 14, 14 and in a wider range of angle, and a base-circle portion $\mathbf{15}_2$.

Collars 21, 21 are provided at upper ends of valve stems 20, 20 of the intake valves 10, 10, respectively, and the intake valves 10, 10 are biased in a closing direction by valve springs 23, 23 mounted in compressed states between a cylinder head 22 and the collars 21, 21, respectively. The first and third rocker arms 17 and 19 swingably carried at one end thereof on the rocker shaft 16, have cam slippers $\mathbf{17}_1$ and $\mathbf{19}_1$ formed at their intermediate portions which abut against the pair of low-speed cams 14, 14, respectively. Tappet screws 24, 24 are mounted at the other ends of the first and third rocker arms 17 and 19 for advancing and retracting movements to abut against the upper ends of the valve stems 20, 20 of the intake valves 10, 10, respectively.

The second rocker arm 18 disposed between the pair of intake valves 10, 10 and swingably carried at one end thereof on the rocker shaft 16, is biased by a resilient biasing means 25 which is mounted in a compressed state between the second rocker arm 18 and the cylinder head 22, and a cam slipper $\mathbf{18}_1$ formed at the other end of the second rocker arm 18 abuts against the high-speed cam 15. The resilient biasing means 25 is comprised of a bottomed cylindrical lifter 26 abutting at its closed end against the second rocker arm 18, and a lifter spring 27 for biasing the lifter 26 toward the second rocker arm 18.

Figure 5:
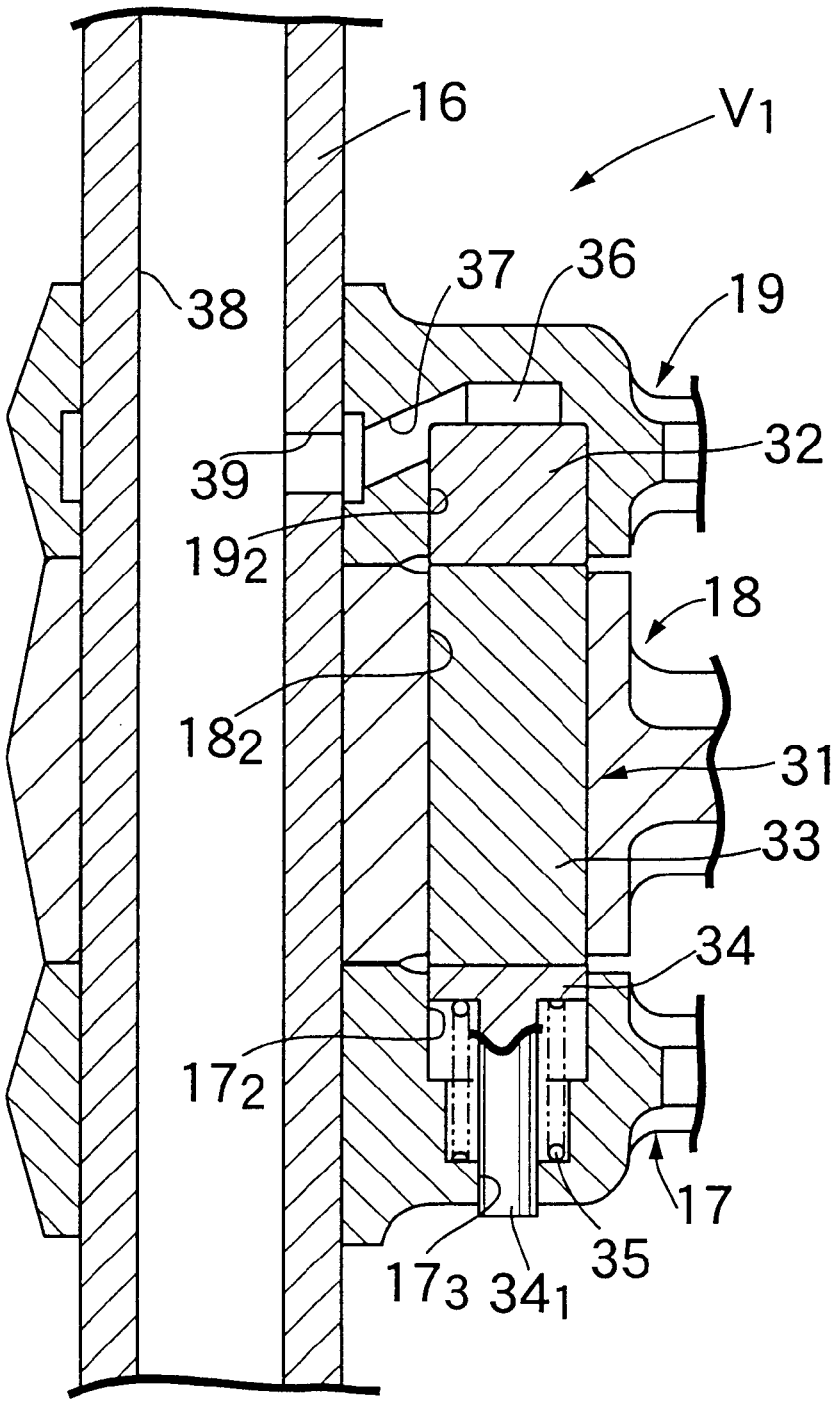

As can be seen from FIG. 5, a connection switching mechanism 31 for switching the connected states of the first, second and third rocker arms 17, 18 and 19 includes a first switching pin 32 capable of connecting the third rocker arm 19 and the second rocker arm 18 to each other, a second switching pin 33 capable of connecting the second rocker arm 18 and the first rocker arm 17 to each other, a third switching pin 34 for limiting the movements of the first switching pin 32 and the second switching pin 33, and a return spring 35 for biasing the switching pins 32, 33 and 34 in disconnecting directions.

A bottomed guide bore $\mathbf{19}_2$ parallel to the rocker shaft 16, is defined in the third rocker arm 19 with its opened end turned toward the second rocker arm 18. The first switching pin 32 is slidably fitted in the guide bore $\mathbf{19}_2$, and a hydraulic pressure chamber 36 is defined between the first switching pin 32 and a closed end of the guide bore $\mathbf{19}_2$. A communication passage 37 is defined in the third rocker arm 19 to communicate with the hydraulic pressure chamber 36, and a hydraulic pressure supply passage 38 is defined in the rocker shaft 16. The communication passage 37 and the hydraulic pressure supply passage 38 are normally in communication with each other through a communication passage 39 defined in a sidewall of the rocker shaft 16, regardless of the swinging state of the third rocker arm 19.

A guide bore $\mathbf{18}_2$ corresponding to the guide bore $\mathbf{19}_2$ and having the same diameter as the guide bore $\mathbf{19}_2$ is provided through the second rocker arm 18 in parallel to the rocker shaft 16, and the second switching pin 33 is slidably fitted in the guide bore $\mathbf{18}_2$.

A bottomed cylindrical guide bore $\mathbf{17}_2$ corresponding to the guide bore $\mathbf{18}_2$ and having the same diameter as the guide bore $\mathbf{18}_2$ is defined in the first rocker arm 17 in parallel to the rocker shaft 16 with its opened end turned toward the second rocker arm 18, and the third switching pin 34 is slidably fitted in the guide bore $17_2$. Moreover, a shaft portion $34_1$ integrally formed on the third switching pin 34 is slidably guided in a guide portion $17_3$ formed at a closed end of the guide bore $17_2$. The return spring 35 is mounted in the compressed state between the closed end of the guide bore $17_2$ and the third switching pin 34 in such a manner that it is fitted over an outer periphery of the shaft portion $34_1$ of the third switching pin 34, so that the three switching pins 32, 33 and 34 are biased in disconnecting directions, i.e., toward the hydraulic pressure chamber 36 by the resilient force of the return spring 35.

When hydraulic pressure supplied to the hydraulic pressure chamber 36 is released, the three switching pins 32, 33 and 34 are moved in the disconnecting directions by the resilient force of the return spring 35. In this state, the abutting faces of the first switching pin 32 and the second switching pin 33 are between the third rocker arm 19 and the second rocker arm 18, and the abutting faces of the second switching pin 33 and the third switching pin 34 are between the second rocker arm 18 and the first rocker arm 17. Therefore, the first, second and third rocker arms 17, 18 and 19 are in their non-connected states. When hydraulic pressure is supplied to the hydraulic pressure chamber 36, the three switching pins 32, 33 and 34 are moved in connecting directions against the resilient force of the return spring 35, whereby the switching pin 32 is fitted into the guide bore $18_2$, and the second switching pin 33 is fitted into the guide bore $17_2$, thereby causing the first, second and third rocker arms 17, 18 and 19 to be connected integrally to one another.

Figure 2:
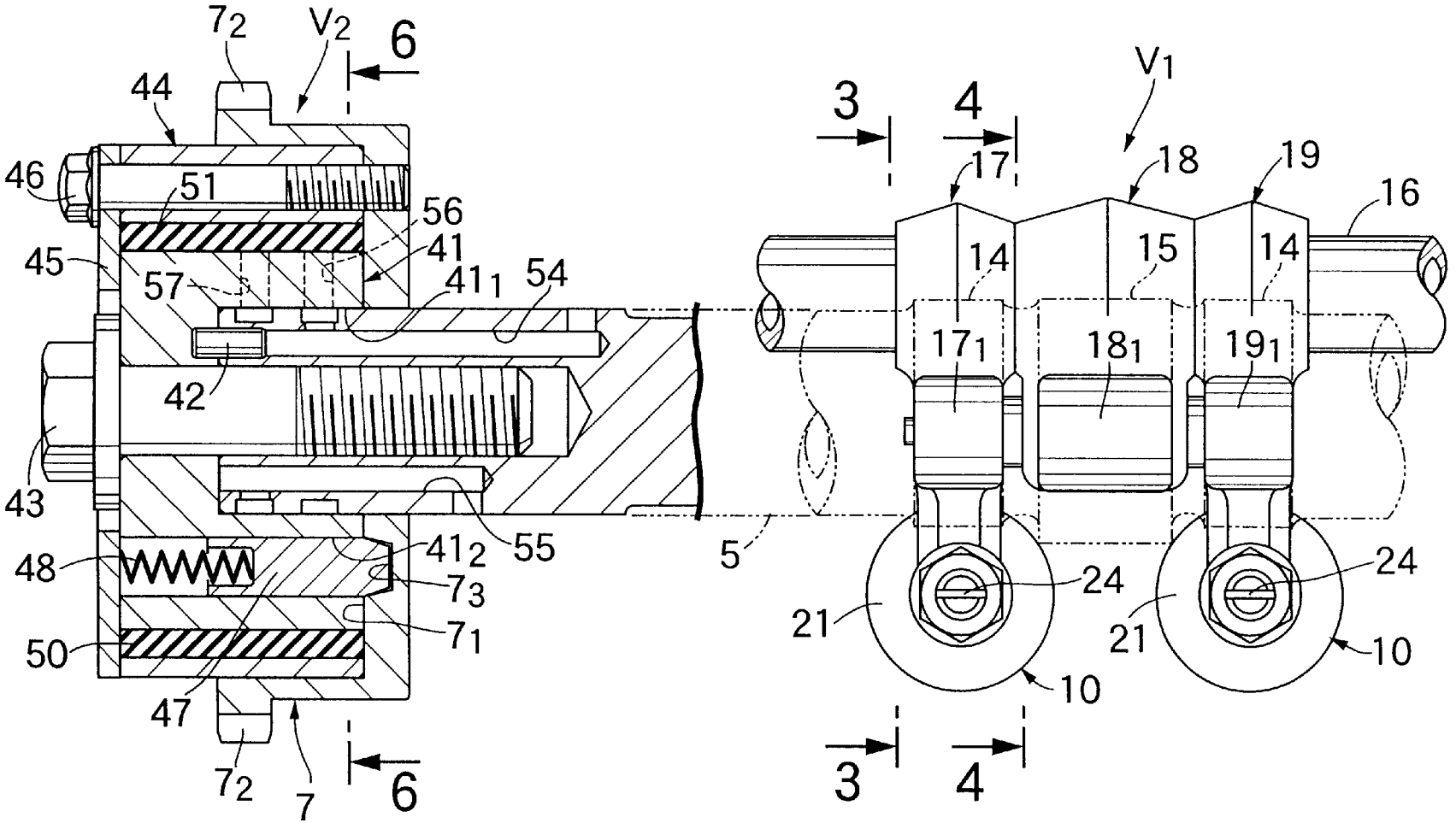
Figure 3:
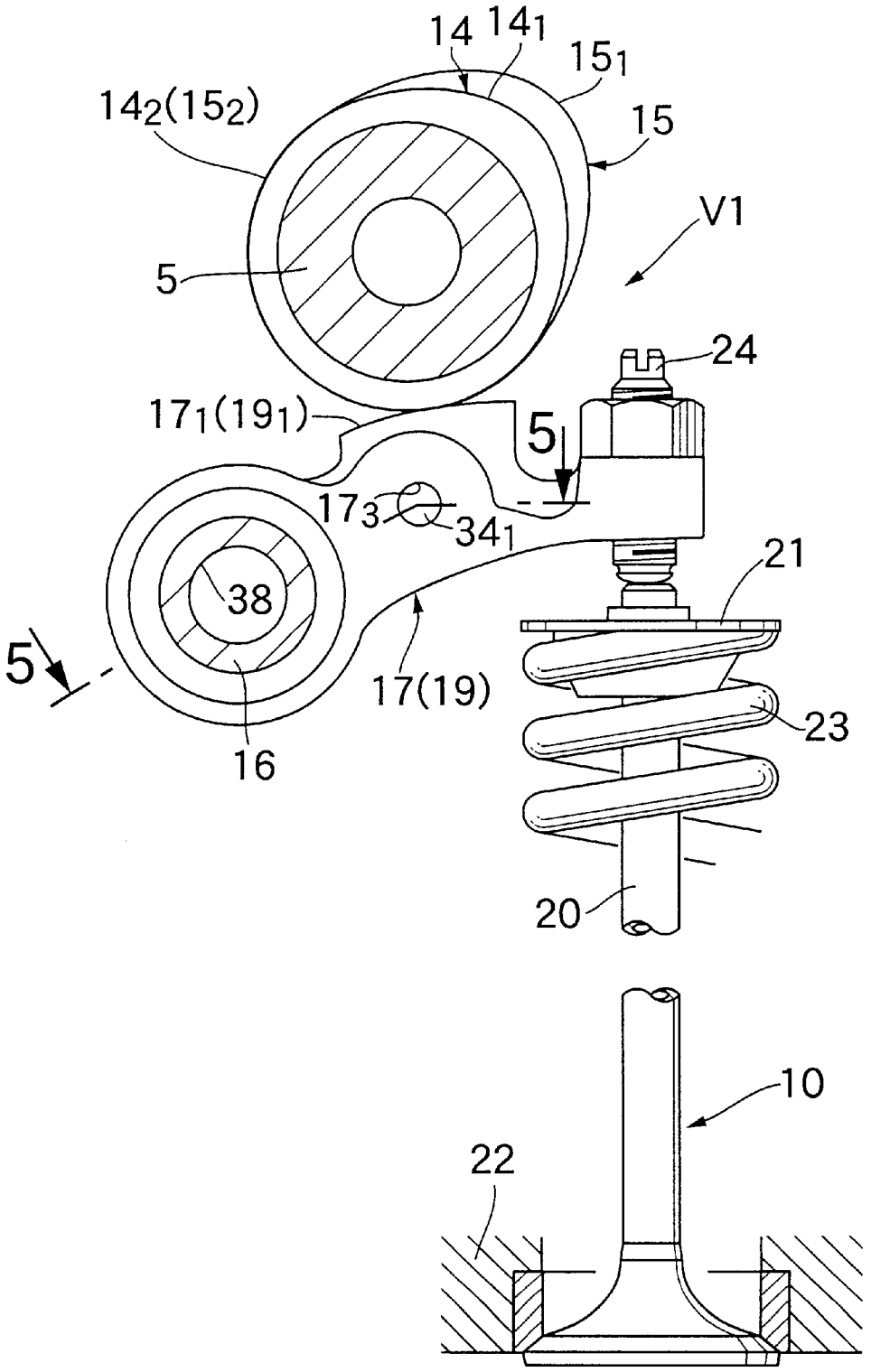
Figure 4:
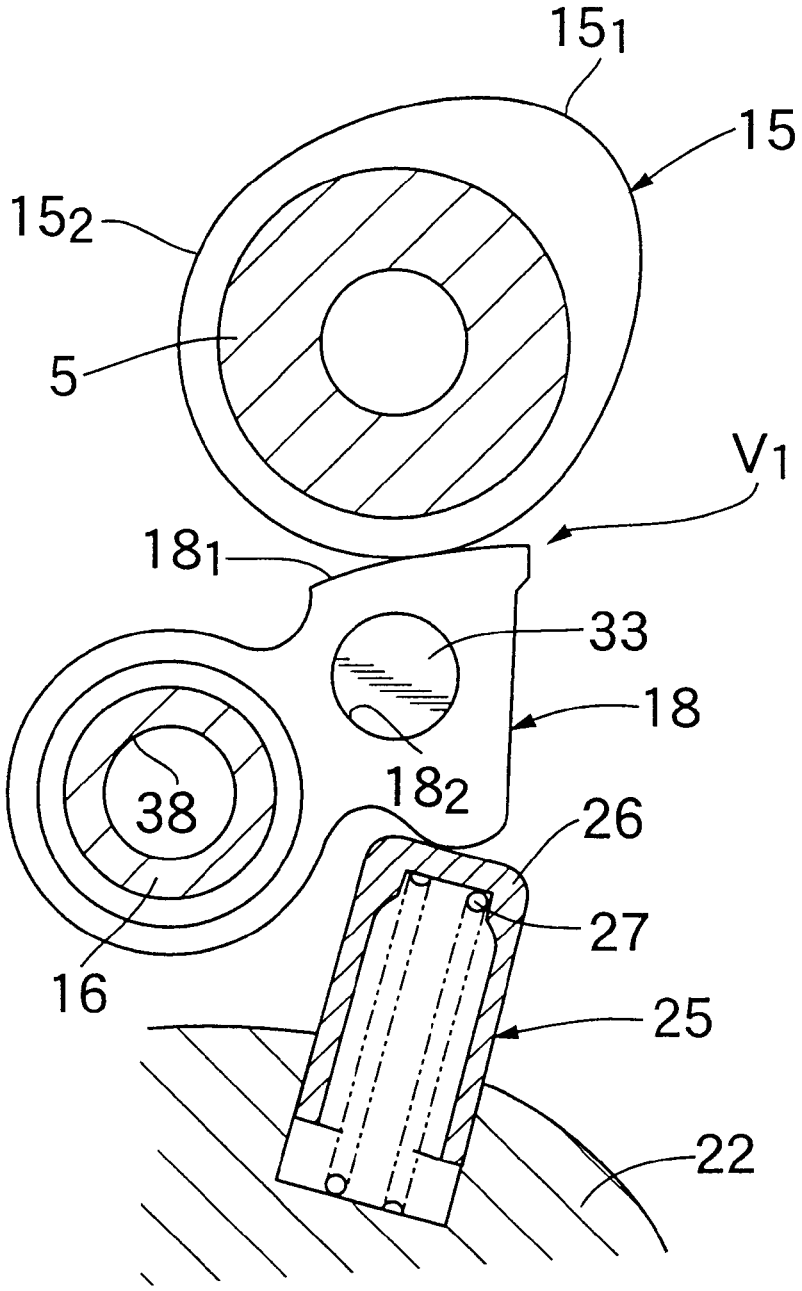

The structure of the second valve operating characteristic changing mechanism $V_2$ provided at the end of the intake cam shaft 4 will be described below with reference to FIGS. 2 and 6.

A support bore $41_1$ defined in the center of a substantially cylindrical boss member 41, is coaxially fitted with the end of the intake cam shaft 5 and coupled to the end in a non-rotatable manner by a pin 42 and a bolt 43. The follower sprocket 7, around which the timing belt 9 is reeved, is formed into a substantially cup shape having a circular recess $7_1$, and sprocket teeth $7_2$ are formed around an outer periphery of the follower sprocket 7. An annular housing 44 fitted in the recess $7_1$ of the follower sprocket 7 and a plate 45 superposed on an outer side of the housing 44 are coupled to the follower sprocket 7 by four bolts 46 passing through the housing 44 and the plate 45. Therefore, the boss member 41 integrally coupled to the intake cam shaft 5, is relatively rotatably accommodated in a space surrounded by the housing 44 and the plate 45. A locking pin 47 is slidably fitted in a pin bore $41_2$ provided axially through the boss member 41. The locking pin 47 is biased in a direction to engage a locking bore $7_3$ defined in the follower sprocket 7 by a spring 48 mounted in a compressed state between the locking pin 47 and the plate 45.

Four fan-shaped recesses $44_1$ are provided in the housing 44 at distances of 90° about the axis of the intake cam shaft 5. Four vanes 49 protruding radiantly from the outer periphery of the boss member 41 are fitted in the recesses $44_1$, so that they can be relatively rotated in a range of a center angle of 30°. Four seal members 50 are mounted at tip ends of the four vanes 49 to abut against ceiling walls of the recesses $44_1$ for sliding movement, and four seal members 51 are mounted in an inner peripheral surface of the housing 44 to abut against an outer peripheral surface of the boss member 41 for sliding movement, whereby an advancing chamber 52 and a retarding chamber 53 are defined on opposite sides of each of the vanes 49.

An advancing oil passage 54 and a retarding oil passage 55 are defined in the intake cam shaft 5. The advancing oil passages 54 communicate with the four advancing chambers 52 through four oil passages 56 provided radially through the boss member 41, respectively. The retarding oil passages 55 communicate with the four retarding chambers 53 through four oil passages 57 provided radially through the boss member 41, respectively. The locking bore $7_3$ in the follower sprocket 7, in which a head of the locking pin 47 is fitted, communicates with any of the advancing chambers 52 through an oil passage which is not shown.

Figure 6:
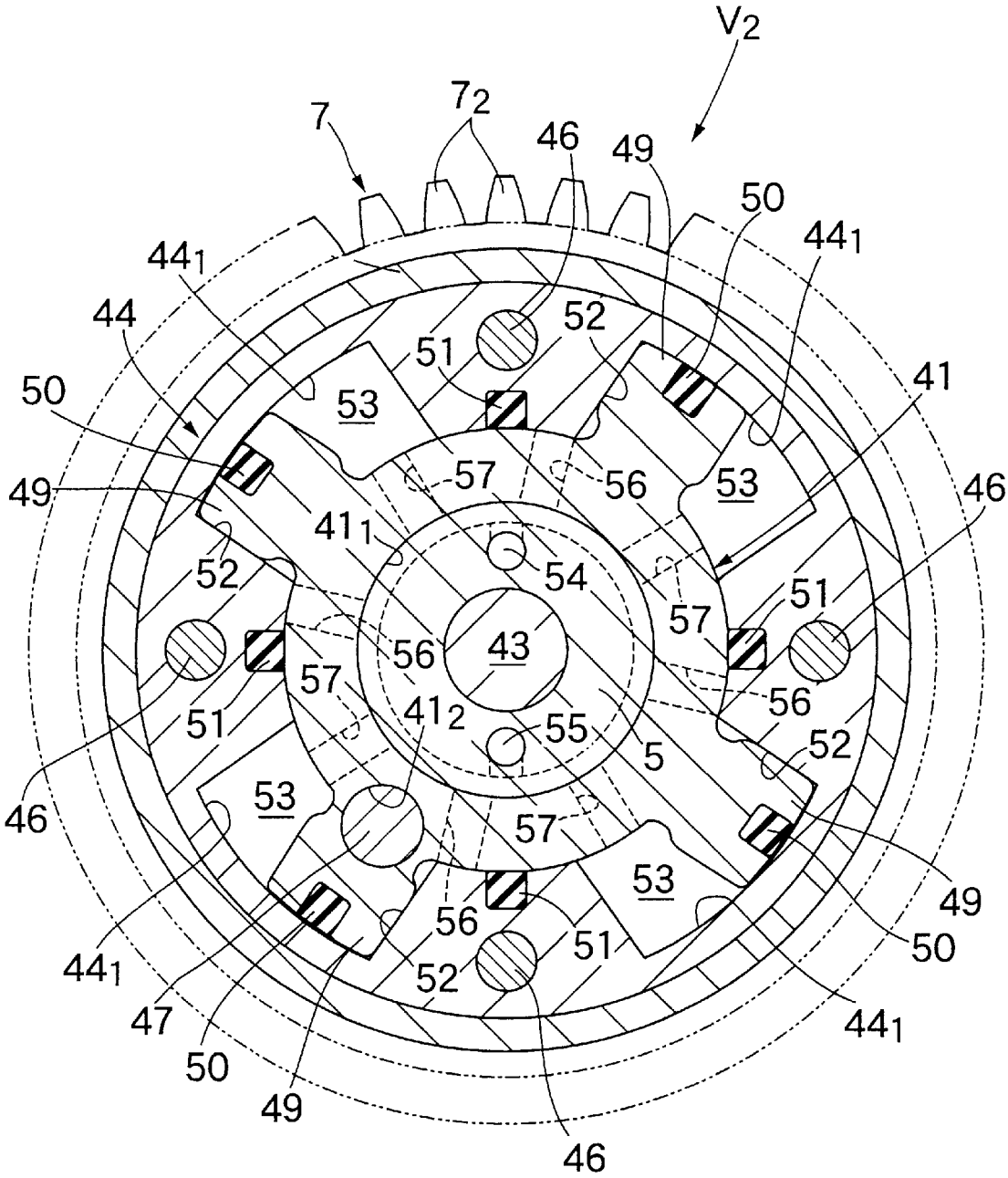

Thus, when no hydraulic pressure is supplied to the advancing chambers 52, the head of the locking pin 47 is fitted in the locking bore $7_3$ in the follower sprocket 7 by the resilient force of a spring 48, and the intake cam shaft 5 is locked in the most-retarded state (in a most-displaced basic position) in which it has been rotated in a counterclockwise direction relative to the follower sprocket 7, as shown in FIG. 6. When hydraulic pressure supplied to the advancing chambers 52 is increased from this state, the locking pin 47 is moved out of the locking bore $7_3$ in the follower sprocket 7 against the resilient force of the spring 48 by the hydraulic pressure transmitted from any of the advancing chambers 52, and pushed by the vanes 49 under the action of a difference in pressure between the advancing chambers 52 and the retarding chambers 53. This causes the intake cam shaft 5 to be rotated relative to the follower sprocket 7 in a clockwise direction (in a direction opposite to a direction of rotation of the crankshaft 3 of the internal combustion engine E, as viewed in FIG. 1), whereby the phases of the low-speed cams 14, 14 and the high-speed cam 15 are advanced in unison with each other to change the timing of opening and closing of the intake valves 10, 10 in an advancing direction. Therefore, it is possible to continuously change the timings of opening and closing of the intake valves 10, 10 by controlling the hydraulic pressures in the advancing chambers 52 and the retarding chambers 53.

Figure 7:
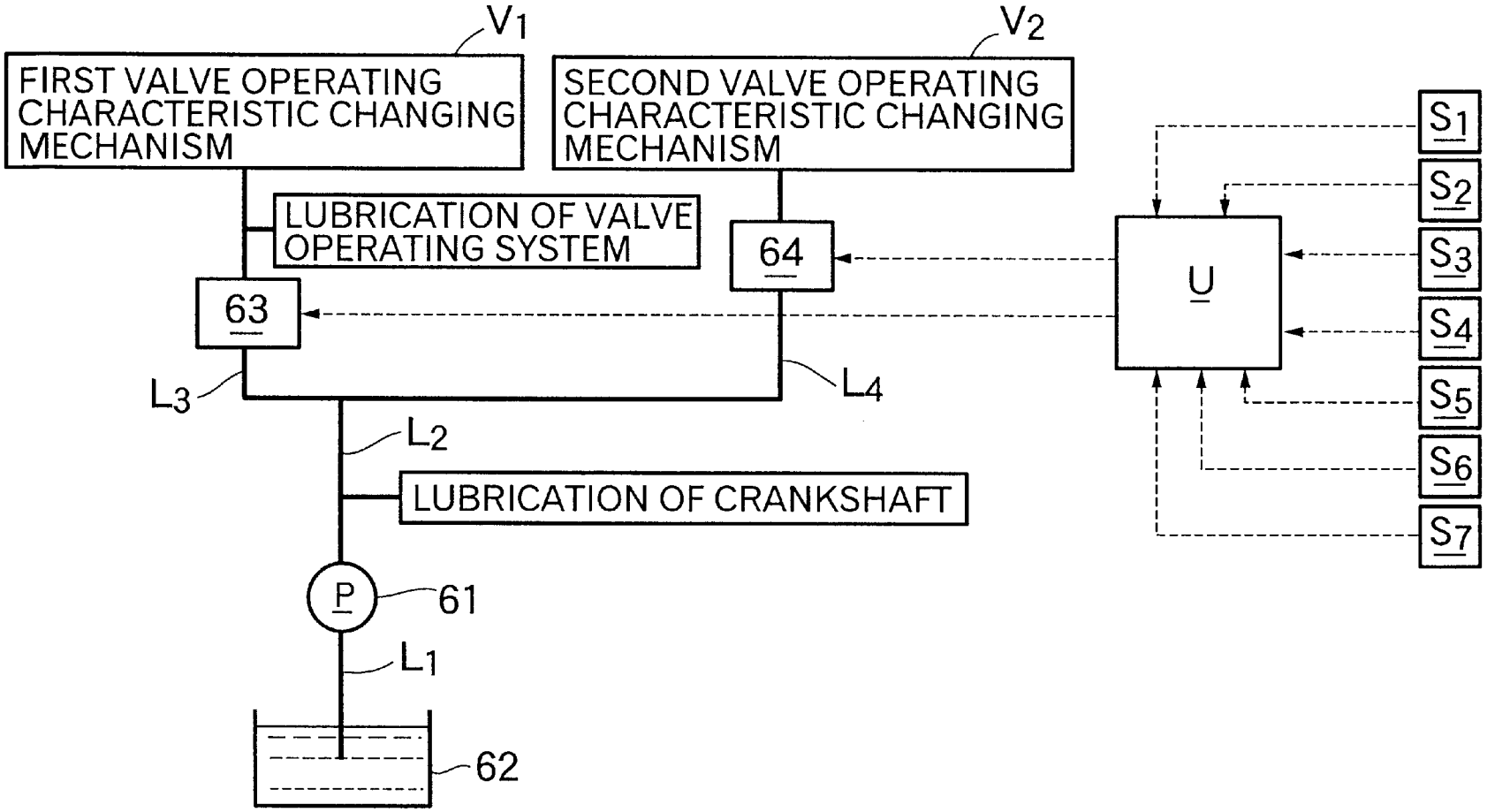

A control system for the first and second valve operating characteristic changing mechanisms $V_1$ and $V_2$ will be described below with reference to FIG. 7.

Oil pumped by an oil pump 61 from an oil pan 62 in the bottom of the crankcase through an oil passage $L_1$ is discharged to an oil passage $L_2$ as lubricating oil for parts or portions around the crankshaft of the internal combustion engine E and for the valve operating mechanism and as a working oil for the first and second valve operating characteristic changing mechanisms $V_1$ and $V_2$. A first hydraulic pressure control valve 63 comprising an ON/OFF solenoid valve for switching the hydraulic pressure at two stages, is provided in an oil passage $L_3$ which is diverted from the oil passage $L_2$, to communicate with the intake-side and exhaust-side first valve operating characteristic changing mechanisms $V_1$, $V_1$. A second hydraulic pressure control valve 64 comprising a duty solenoid valve for continuously controlling the hydraulic pressure is provided in an oil passage $L_4$ which is diverted from the oil passage $L_2$ to communicate with the second valve operating characteristic changing mechanism $V_2$.

An electronic control unit U is provided as a control means which receives a signal from a cam shaft sensor $S_1$ for detecting the phase of the intake cam shaft 5, a signal from a TDC sensor $S_2$ for detecting top dead centers of the pistons 1 based on the phase of the exhaust cam shaft 6, a signal from an intake negative-pressure sensor $S_4$ for detecting an intake negative pressure, a signal from a cooling-water temperature sensor $S_5$ for detecting the temperature of cooling water, and a signal from an engine rotational-speed sensor $S_7$ for detecting the rotational speed of the engine. The electronic control unit U controls the operation of the first hydraulic pressure control valve 63 for the first valve operating characteristic changing mechanisms $V_1$, $V_1$ and the operation of the second hydraulic pressure control valve 64 for the second valve operating characteristic changing mechanisms $V_2$.

The structure of the second hydraulic pressure control valve 64 for the second valve operating characteristic changing mechanisms $V_2$ will be described below with reference to FIG. 8.

The second hydraulic pressure control valve 64 includes a cylindrical sleeve 65, a spool 66 slidably fitted in the sleeve 65, a duty solenoid 67 fixed to the sleeve 65 for driving the spool 66, and a spring 68 for biasing the spool 66 toward the duty solenoid 67. The axial position of the spool 66 slidably fitted in the sleeve 65 can be varied continuously by duty-controlling the current in the duty solenoid 67 by a command from the electronic control unit U.

Defined in the sleeve 65 are a central input port 69, a retarding port 70 and an advancing port 71 located on the opposite sides of the input port 69, and a pair of drain ports 72 and 73 located on the opposite sides of the retarding port 70 and the advancing port 71. The spool 66 slidably received in the sleeve 65, is provided with a central groove 74, a pair of lands 75, 75 located on opposite sides of the groove 74, and a pair of grooves 77 and 78 located on opposite sides of the lands 75 and 76. The input port 69 is connected to the oil pump 61; the retarding port 70 is connected to the retarding chambers 53 in the second valve operating characteristic changing mechanism $V_2$, and the advancing port 71 is connected to the advancing chambers 52 in the second valve operating characteristic changing mechanism $V_2$.

The operation of the first valve operating characteristic changing mechanism $V_1$ will be described below.

During rotation of the internal combustion engine E at a low speed, the first hydraulic pressure control valve 63 comprising an ON/OFF solenoid valve is turned off by a command from the electronic control unit U, thereby cutting off the hydraulic pressure supplied from the oil pump 61 to the connection switching mechanism 31 of the first valve operating characteristic changing mechanism $V_1$. At this time, hydraulic pressure is not applied to the hydraulic pressure chamber 36 connected to the hydraulic pressure supply passage 38 within the rocker shaft 16, and the first, second and third switching pins 32, 33 and 34 are moved to the disconnecting positions shown in FIG. 5 by the resilient force of the return spring 35. As a result, the first, second and third rocker arms 17, 18 and 19 are disconnected from one another, and the two intake valves 10, 10 are opened and closed by the first and third rocker arms 17 and 19 having the cam slippers $17_1$ and $19_1$ abutting against the two low-speed cams 14, 14. At this time, the second rocker arm 18 having the cam slipper $18_1$ abutting against the high-speed cam 15 is raced independently of the operation of intake valves 10, 10.

During rotation of the internal combustion engine E at a high speed, the first hydraulic pressure control mechanism 63 comprising the ON/OFF solenoid valve is turned on by a command from the electronic control unit U, and the hydraulic pressure is supplied from the oil pump 61 to the connection switching mechanism 31 of the first valve operating characteristic changing mechanism $V_1$ and transmitted from the hydraulic pressure supply passage 38 within the rocker shaft 16 to the hydraulic pressure chamber 36. As a result, the first, second and third switching pins 32, 33 and 34 are moved to the connecting positions against the resilient force of the return spring 35, and the first, second and third rocker arms 17, 18 and 19 are connected integrally to one another by the first and second switching pins 32 and 33. Therefore, the swinging movement of the second rocker arm 18 having the cam slipper $18_1$ abutting against the high-speed cam 15 including the cam lobe $15_1$ having large ranges of height and angle is transmitted to the first and third rocker arms 17 and 19 connected integrally to the second rocker arm 18, whereby the two intake valves 10, 10 are opened and closed. At this time, the cam lobes $14_1$, $14_1$ of the low-speed cams 14, 14 are moved away from the cam slippers $17_1$ and $19_1$ of the first and third rocker arms 17 and 19 and thus raced.

Thus, during rotation of the internal combustion engine E at the low speed, the intake valves 10, 10 can be driven at a low valve lift and at a small opening angle, and during rotation of the internal combustion engine E at the high speed, the intake valves 10, 10 can be driven at a high valve lift and at a large opening angle. The valve lift and opening angle of the exhaust valves 11, 11 are also controlled in the same manner as the intake valves 10, 10 by the corresponding first valve operating characteristic changing mechanism $V_1$.

The operation of the second valve operating characteristic changing mechanism $V_2$ will be described below.

At the time of stopping of the internal combustion engine E, the second valve operating characteristic changing mechanism $V_2$ is in a state shown in FIG. 6 in which each of the retarding chambers 53 is maximum in volume and each of the advancing chambers 52 is zero in volume, and the locking pin 47 is maintained in a most retarded state in which it has been fitted into the locking bore $7_3$ in the follower sprocket 7. When the internal combustion engine E is started, the oil pump 61 is operated. When the hydraulic pressure transmitted through the second hydraulic pressure control valve 64 to the advancing chambers 52 exceeds a predetermined value (e.g., 1 kg/cm$^2$), the locking pin 47 is moved out from the locking bore $7_3$ by the hydraulic pressure, thereby bringing the second valve operating characteristic changing mechanism $V_2$ into an operable state.

Figure 8:
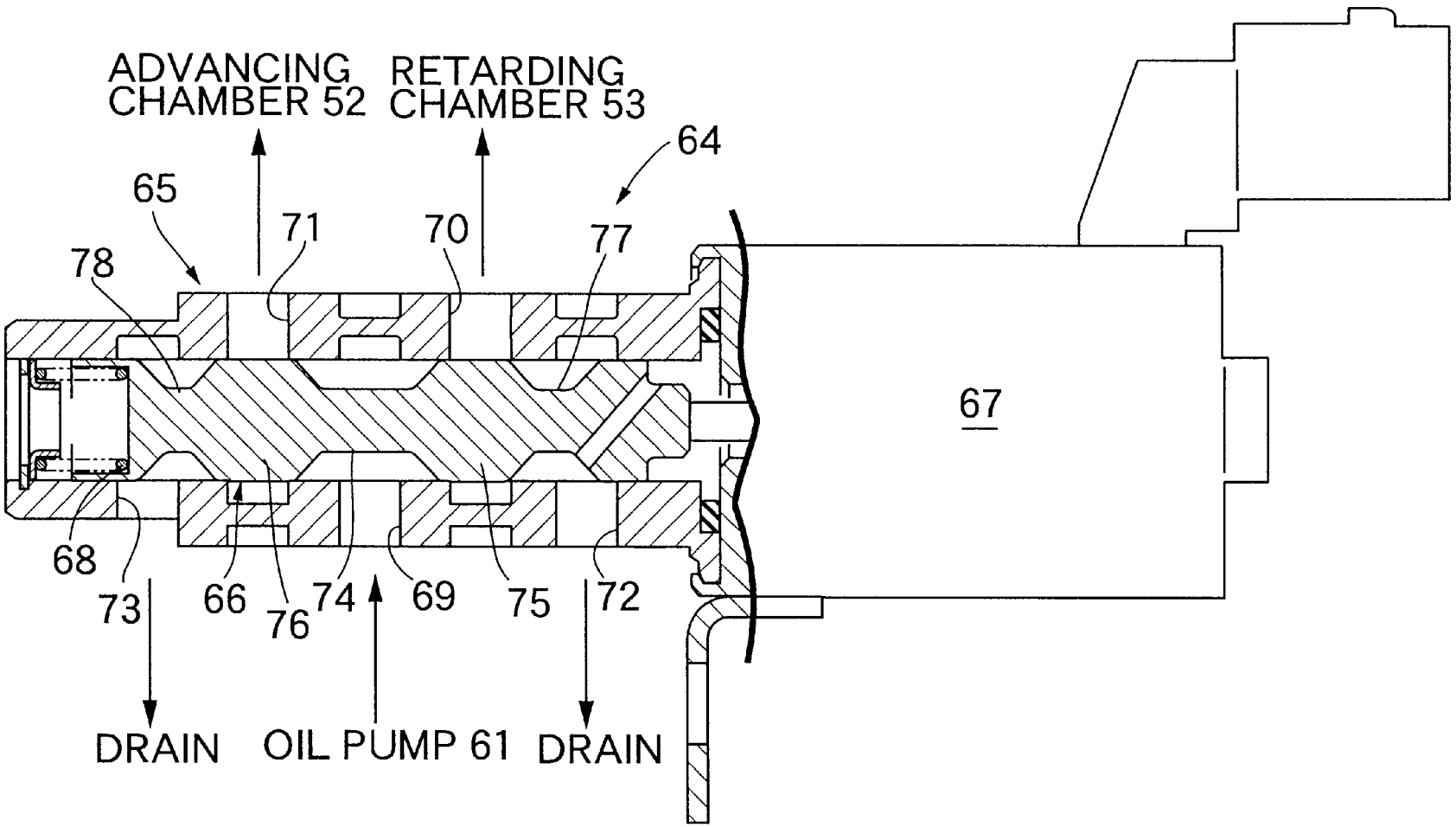

If the duty ratio of the duty solenoid 67 is increased, for example, to 50% or more from this state, the spool 66 is moved to a left side of a neutral position as viewed in FIG. 8 against the resilient force of the spring 68, so that the input port 69 connected to the oil pump 61 communicates with the advancing port 71 through the groove 74, and the retarding port 70 communicates with the drain port 72 through the groove 77. As a result, hydraulic pressure is applied to the advancing chambers 52 in the second valve operating characteristic changing mechanism $V_2$ and hence, the intake cam shaft 5 is rotated in the clockwise direction relative to the follower sprocket 7, whereby the cam phase of the intake shaft 5 is changed continuously in the advancing direction. When a target cam phase is obtained, the duty ratio of the duty solenoid 67 is set at a value (e.g., 50%) corresponding to the high-speed valve timing which will be described hereinafter. Thus, the follower sprocket 7 and the intake cam shaft 5 can be connected integrally to maintain the cam phase by stopping the spool 66 of the second hydraulic pressure control valve 64 in the neutral position shown in FIG. 8, closing the input port 69 between the pair of lands 75 and 76 and closing the retarding port 70 and the advancing port 71 by the lands 75 and 76, respectively.

To continuously change the cam phase of the intake cam shaft 5 in the retarding direction, the duty ratio of the duty solenoid 67 may be decreased to 50% or less to move the spool 66 rightwards from the neutral position, thereby permitting the input port 69 connected to the oil pump 61 to communicate with the retarding port 70 through the groove 74 and permitting the advancing port 71 to communicate with the drain port 73. When the target phase is obtained, if the duty ratio of the duty solenoid 67 is set at 50%, whereby the spool 66 is stopped in the neutral portion shown in FIG. 8, the input port 69, the retarding port 70 and the advancing port 71 can be closed to maintain the cam phase.

Thus, the timing of the opening and closing of the intake valves 10, 10 can be advanced and retarded continuously over a range of a rotational angle of 30° of the intake cam shaft 5 (over a range of 60°, if it is converted into a rotational angle of the crankshaft 3).

When the internal combustion engine E is in an extremely low load and a high-speed rotating state, the first valve operating characteristic changing mechanism $V_1$ is controlled to a high-speed valve timing state, and the second valve operating characteristic changing mechanism $V_2$ is controlled to a most-retarded state. To set the second valve operating characteristic changing mechanism $V_2$ in the most-retarded state, the duty ratio of the duty solenoid 67 of the second hydraulic pressure control valve 64 may be decreased to 0% to move the spool 66 rightwards as viewed in FIG. 8, thereby permitting the oil from the oil pump 61 to be supplied to the retarding chambers 53. However, if this is done, there is a possibility that the amount of oil supplied from the oil pump 61 via the first hydraulic pressure control valve 63 to the first valve operating characteristic changing mechanism $V_1$ is reduced due to the leakage of the oil from the retarding chambers 53, because the first valve operating characteristic changing mechanism $V_1$ and the second valve operating characteristic changing mechanism $V_2$ are adapted to receive the hydraulic pressure from the common oil pump 61, and hence, the establishment of the high-speed valve timing state of the first valve operating characteristic changing mechanism $V_1$ is unstable, if the volume of the oil pump 61 is set at a sufficiently large value.

Therefore, in the present embodiment, when the first valve operating characteristic changing mechanism $V_1$ is controlled to the high-speed valve timing state, the duty ratio of the duty solenoid 67 of the second hydraulic pressure control valve 64 is set at the predetermined value (e.g., 50%) corresponding to the high-speed valve timing to fix the second valve operating characteristic changing mechanism $V_2$ in the most-retarded state. In other words, the spool 66 is moved rightwards as viewed in FIG. 8 by setting the duty ratio at 0% to supply the hydraulic pressure to the retarding chambers 53, thereby controlling the second valve operating characteristic changing mechanism $V_2$ to the most-retarded state. Thereafter, the duty ratio is maintained at 50% to return the spool 66 to the neutral position, thereby closing the input port 69 in the second hydraulic pressure control valve 64 connected to the oil pump 61; and closing the advancing port 71 connected to the advancing chambers 52 and the retarding port 70 connected to the retarding chambers 53.

When the second valve operating characteristic changing mechanism $V_2$ is in the most-retarded state by the above-described control, the hydraulic pressure from the oil pump 61 can be shut off by the second hydraulic pressure control valve 64, whereby the leakage of the oil in the second valve operating characteristic changing mechanism $V_2$ can be prevented. Therefore, hydraulic pressure for establishing the high-speed valve timing state can be ensured in the second valve operating characteristic changing mechanism $V_2$ without increasing the volume of the oil pump 61 to guarantee the reliability of the valve operating characteristic changing control. Moreover, the duty ratio of the duty solenoid 67 of the second hydraulic pressure control valve 64 is set at 50% to maintain the spool in the neutral state and hence, in changing the cam phase of the second valve operating characteristic changing mechanism $V_2$ in the advancing direction from the most-retarded state, the hydraulic pressure in the advancing chambers 52 can be raised quickly to enhance the responsiveness.

The operation of the second valve operating characteristic changing mechanism $V_2$ will be described below in further detail with reference to the flow chart.

Figure 9:
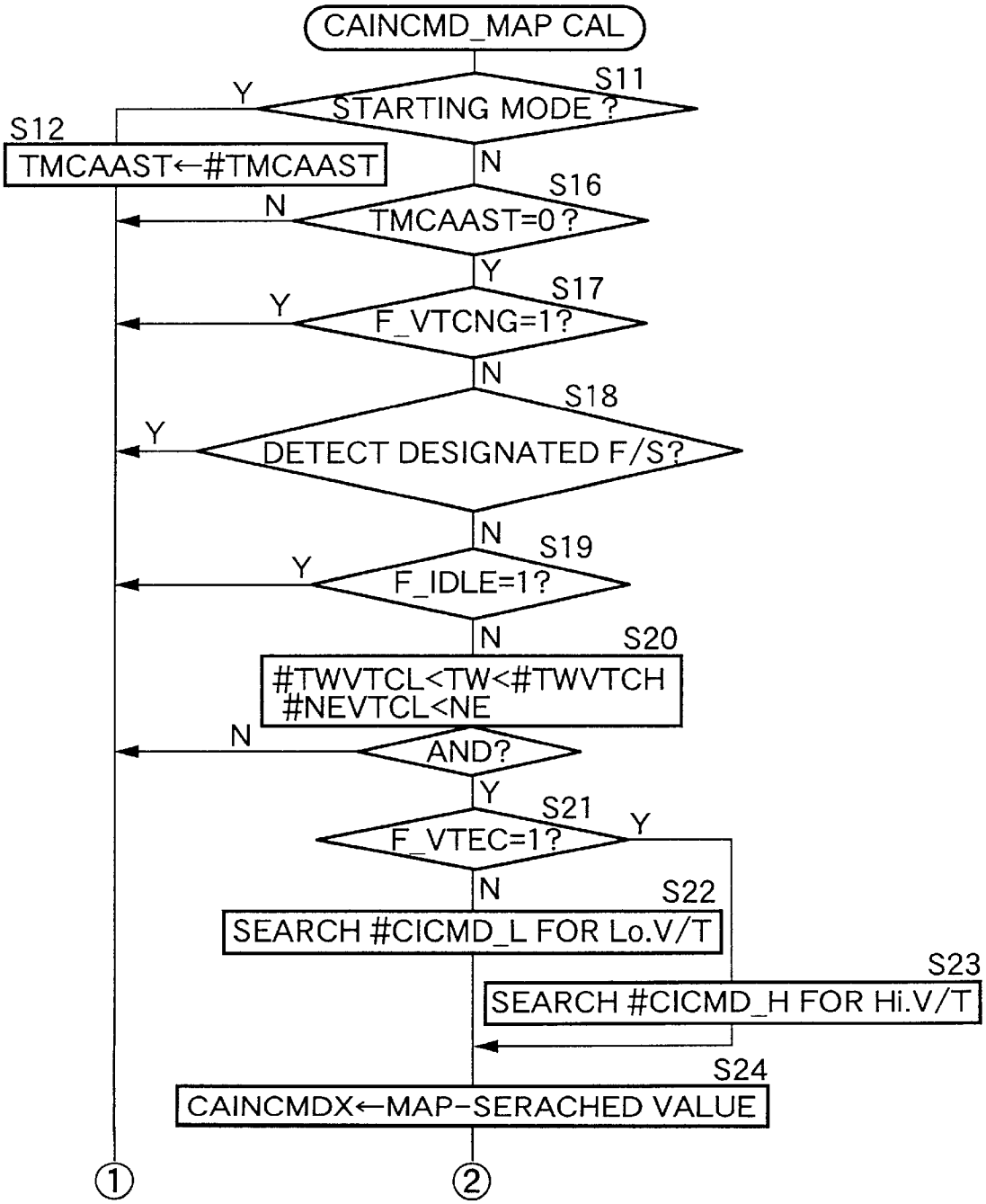
Figure 10:
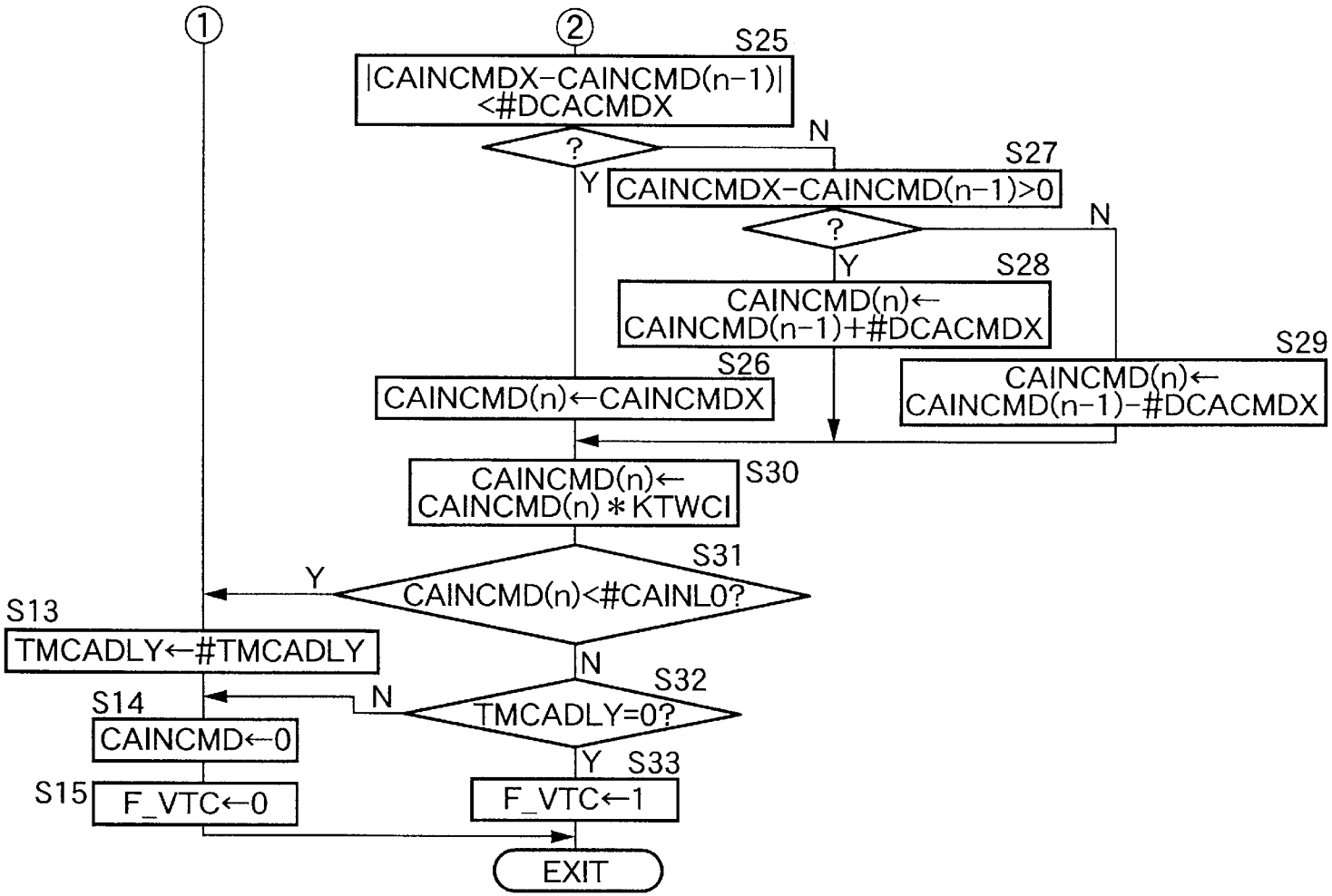

The flow chart in FIGS. 9 and 10 show a routine for calculating a target cam phase CAINCMD. This routine is carried out at every predetermined time interval. First, when the internal combustion engine E is in a starting mode at Step S11, an after-start cam phase changing control prohibiting timer TMCAAST is set at a predetermined time #TMCAAST (e.g., 5 sec) at Step S12. A second valve operating characteristic changing mechanism operating delay timer TMCADLY is set at a predetermined time #TMCADLY (e.g., 500 msec) at Step S13, and the target cam phase CAINCMD is set at 0 at Step S14. A second valve operating characteristic changing mechanism control permitting flag F_VTC for indicating whether the operation of the second valve operating characteristic changing mechanism $V_2$ is permitted, is set "0" (which indicates the prohibition of the operation of the second valve operating characteristic changing mechanism $V_2$) at Step S15.

After the internal combustion engine E begins to come out of the starting mode at Step S11 into a basic mode, the processing is advanced to Steps S13 to S15 to prohibit the operation of the second valve operating characteristic changing mechanism $V_2$, before the counting of the after-start cam phase changing control prohibiting timer TMCAAST is completed. When the counting of the after-start cam phase changing control prohibiting timer TMCAAST has completed, and 5 seconds have lapsed after the starting, the processing is advanced to Step S17. If a second valve operating characteristic changing mechanism failure flag F_VTCNG has been set at "1" (which indicates a failure) at Step S17, or another failure has been produced at Step S18, the processing is advanced to Steps S13 to S15 to prohibit the operation of the second valve operating characteristic changing mechanism $V_2$.

If no failure has been produced at Steps S17 and S18, an idle flag F_IDLE is referred to at Step S19. When the idle flag F_IDLE has been set at "1" to indicate that the internal combustion engine E is in an idling state, for example, when the throttle opening degree TH detected by a throttle opening degree sensor $S_6$ is a value corresponding to a full opening state, and the engine rotational speed NE detected by the engine rotational speed sensor $S_7$ is near 700 rpm, the processing is advanced to Steps S13 to S15 to prohibit the operation of the second valve operating characteristic changing mechanism $V_2$.

If the idle flag F_IDLE has been set at "0" to indicate that the internal combustion engine E is not in the idling state, it is determined at Step S20 whether the temperature of cooling water detected by the cooling-water temperature sensor $S_5$ is between a lowest limit value #TWVTCL (e.g., 0° C.) and a highest limit value #TWVTCH (e.g., 110° C.), and whether the engine rotational speed detected by the engine rotational speed sensor $S_7$ is smaller than a lowest limit value #NEVTCL (e.g., 1,500 rpm). If any of the above-described conditions is not established, the processing is advanced to Steps S13 to S15 to prohibit the operation of the second valve operating characteristic changing mechanism $V_2$.

If all of the conditions at Steps S11 and S16 to S20 are established, the processing is advanced to Step S21 to operate the second valve operating characteristic changing mechanism $V_2$. If the first valve operating characteristic changing mechanism control permitting flag F_VTEC is at "0" at Step S21 to indicate that the first valve operating characteristic changing mechanism $V_1$ has established the low-speed valve timing, a target cam phase #CICMD_L corresponding to the low-speed valve timing is searched from a map at Step S22. On the other hand, if the first valve operating characteristic changing mechanism control permitting flag F_VTEC is at "1" to indicate that the first valve operating characteristic changing mechanism $V_1$ has established the high-speed valve timing, a target cam phase #CICMD_H corresponding to the high-speed valve timing is searched from a map at Step S23. The maps used at Steps S22 and S23 are established with the intake negative pressure PBA detected by the intake negative pressure sensor $S_4$ and the engine rotational speed NE detected by the engine rotational speed sensor S7 being used as parameters.

At subsequent Step S24, the target cam phases #CICMD_L and #CICMD_H which are map values detected at Step S22 and S23 are determined as a target cam phase CAINCMDX. Then, at Step S25, an absolute value of a deviation resulting from the subtraction of the last value CAINCMD(n−1) of the target cam phase from the target cam phase CAINCMDX is compared with a cam phase operation-amount limit value #DCACMDX (e.g., 2° in terms of a crank angle). As a result, when the relation, |CAINCMDX−CAINCMD(n−1)|<#DCACMDX is established, i.e., the absolute value of the deviation is relatively small, the target cam phase CAINCMDX is determined as a current value CAINCMD(n) of the target cam phase at Step S26.

On the other hand, when the relation, |CAINCMDX−CAINCMD(n−1)|<#DCACMDX is not established, i.e., the absolute value of the deviation is relatively large at Step S25, the sign of the deviation CAINCMDX−CAINCMD(n−1) is determined at Step S27. As a result, if the deviation CAINCMDX−CAINCMD(n−1)>0 is established, a value resulting from the addition of the cam phase operation-amount limit value #DCACMDX to the last value CAINCMD(n−1) of the target cam phase is determined as the current value CAINCMD(n) of the target cam phase at Step S28 to stepwise change the cam phase in the advancing direction. On the other hand, if the deviation CAINCMDX−CAINCMD(n−1)>0 is not established, a value resulting from the subtraction of the cam phase operation-amount limit value #DCACMDX from the last value CAINCMD (n−1) of the target cam phase is determined as the current value CAINCMD)(n) of the target cam phase at Step S29 to stepwise change the cam phase in the retarding direction.

If the deviation be ween the current value CAINCMD(n) and the last value CAINCMD(n−1) of the target cam phase exceeds the cam phase operation-amount limit value #DCACMDX, the target cam phase is changed gradually rather than quickly, thereby making it possible to prevent an overshoot from being caused during feedback control of the cam phase due to the quick changing of the cam phase, and to prevent the unnecessary changing of the cam phase, when the engine rotational speed is increased instantaneously and returned immediately to the original value, for example, during shift-changing or the like.

At subsequent Step S30, the current value CAINCMD(n) of the target cam phase is corrected by multiplying the current value CAINCMD(n) by the water temperature correcting factor KTWCI. The water temperature correcting factor KTWCI searched using the cooling-water temperature TW detected by the cooling-water temperature sensor $S_5$ as a parameter, is set so that it is equal to 1, when the cooling-water temperature TW is equal to or higher than a predetermined value, and it is decreased linearly from 1, when the cooling-water temperature TW is lower than the predetermined value.

Then, at Step S31, the current value CAINCMD(n) of the target cam phase is compared with a control-executed cam phase #CAINL0 (e.g., 3° or 5° in terms of the crank angle) from the most-retarded position. If the current value CAINCMD(n) of the target cam phase is smaller than the control-executed cam phase #CAINL0, namely, if the control amount from the most-retarded position is an extremely small target cam phase (e.g., during low-load operation immediately after an idling-released state), a very large difference cannot be produced in the operational state, as compared with the case where a driving force is applied to the second hydraulic pressure control valve 64 and the second valve operating characteristic changing mechanism $V_2$, and there is little difference between when the cam phase has been changed and when the cam phase has not been changed. Therefore, the processing is advanced to Steps S13 to S15 to prohibit the operation of the second valve operating characteristic changing mechanism $V_2$.

When the current value CAINCMD(n) of the target cam phase is equal to or larger than the control-executed cam phase #CAINL0 at Step S31, there is a pause at Step S32 for the counting of the second valve operating characteristic changing mechanism operating delay timer TMCADLY to be completed to prevent hunting upon switching between the starting mode and the basic mode, and thereafter, the second valve operating characteristic changing mechanism control permitting flag F_VTC is set at "1" at Step S33 to permit the operation of the second valve operating characteristic changing mechanism $V_2$.

Figure 11:
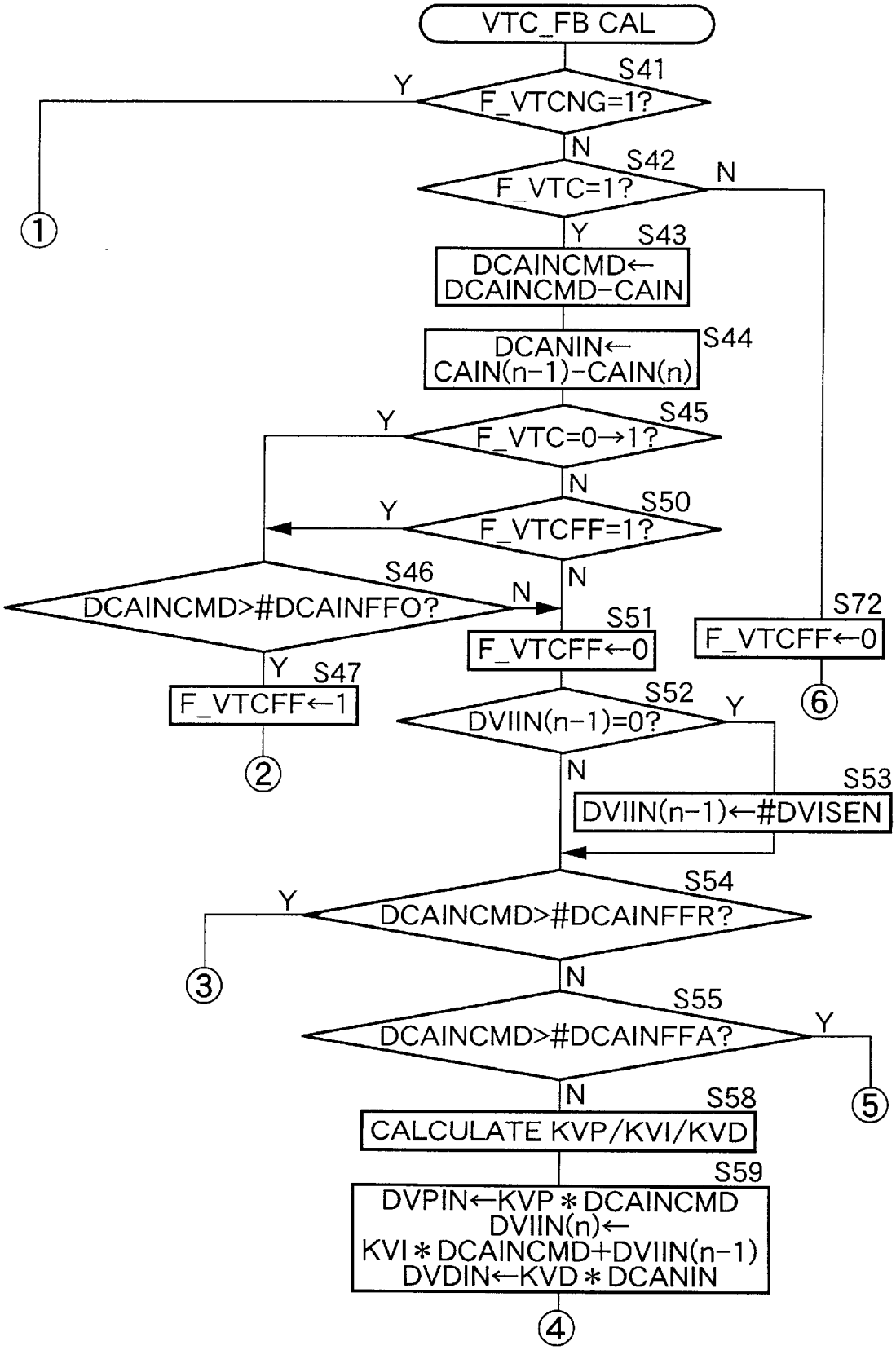
Figure 12:
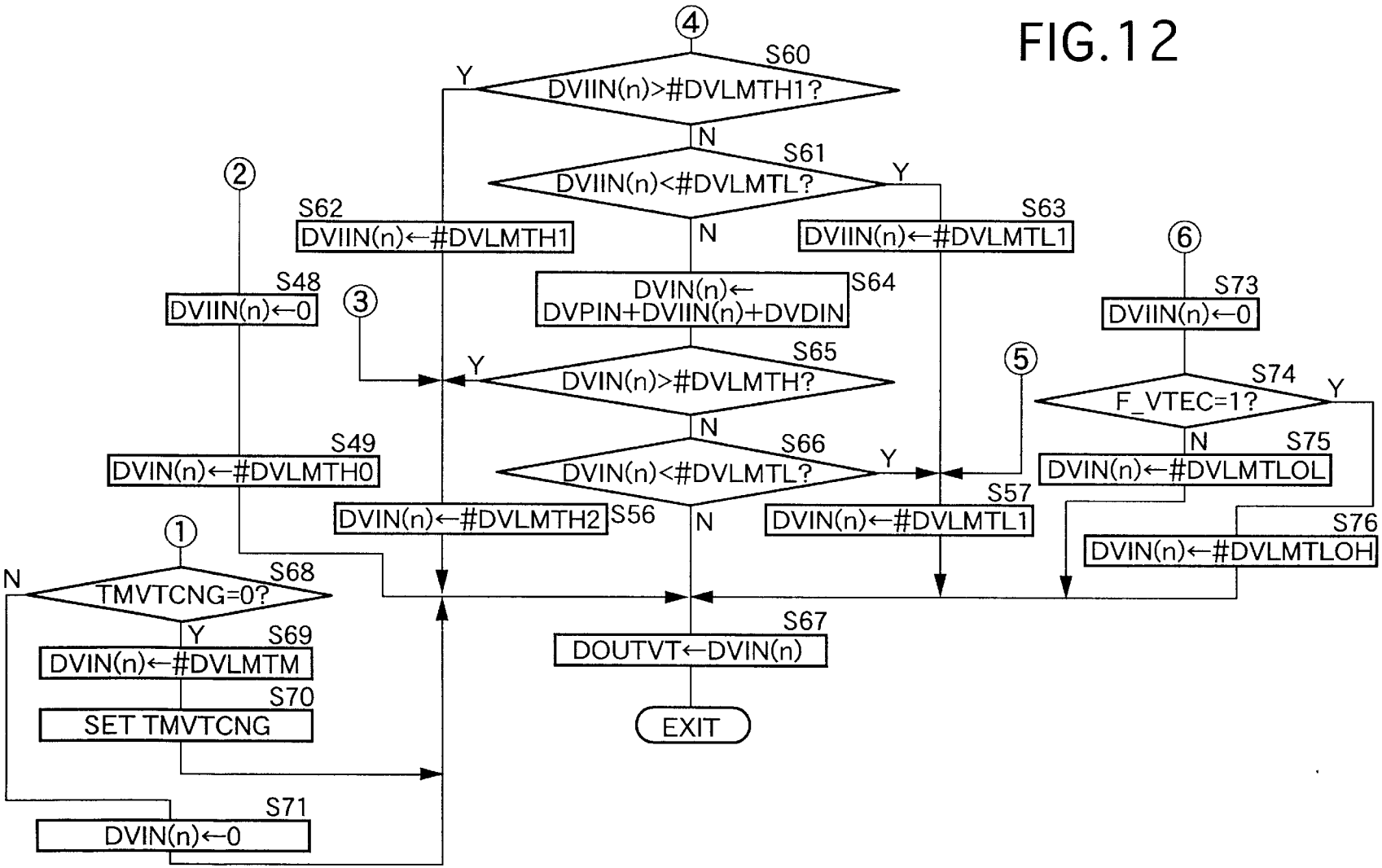
Figure 13:
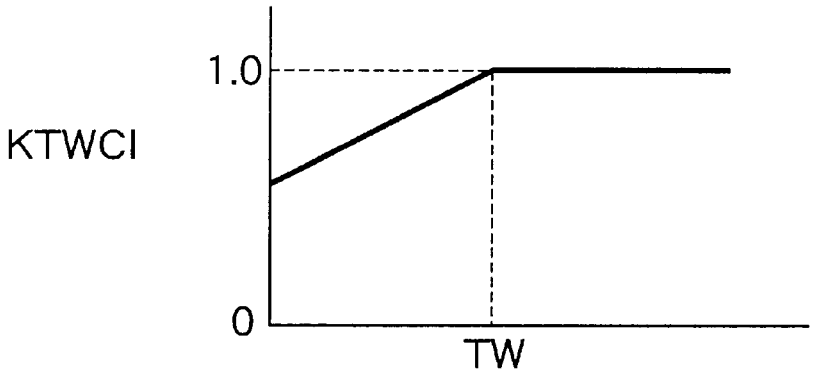

The flow chart shown in FIGS. 11 and 12 shows a routine of feedback-control of the cam phase by the second valve operating characteristic changing mechanism $V_2$. This routine is carried out at every predetermined time interval. First, when the second valve operating characteristic changing mechanism failure flag F_VTCNG has been set at "0" at Step S41 to indicate that the second valve operating characteristic changing mechanism $V_2$ is normal, and the second valve operating characteristic changing mechanism control permitting flag F VTC has been set at "1" at Step S42 to indicate that the second valve operating characteristic changing mechanism $V_2$ is in operation, a deviation DCAINCMD between the target cam phase CAINCMD calculated in the routine shown in FIGS. 9 and 10 and an actual cam phase CAIN calculated from the outputs from the cam shaft sensor $S_1$ and the crankshaft sensor $S_3$ is calculated at Step S43, and a deviation DCANIN between the last value CAIN(n−1) and the current value CAIN(n) of the actual cam phase is calculated at Step S44.

If the second valve operating characteristic changing mechanism control permitting flag F_VTC has been changed from "0" to "1" at Step S45, i.e., if the operation of the second valve operating characteristic changing mechanism $V_2$ has been changed frown the prohibition to the permission in a current loop, the processing is advanced to Step S46, at which the deviation DCAINCMD is compared with a first feed-forward control determining value #DCAINFFO (e.g., 10° in terms of the clank angle). As a result, if the deviation DCAINCMD is larger than the first seed-forward control determining value #DCAINFFO, a second valve operating characteristic changing mechanism feed-forward control flag F_VTCFF is set at "1" at Step S47, at which the second valve operating characteristic changing mechanism $V_2$ to be intrinsically feedback controlled is feed-forward controlled.

Namely, a current value DVIIN(n) of an I term for controlling the second valve operating characteristic changing mechanism $V_2$ in a PID feedback manner is set at "0" at Step S48, and a current value DVIN of an operational amount of the second valve operating characteristic changing control is set at a highest limit value #DVLMTHO it Step S49. Thereafter, a duty ratio DOUTTVT of the second hydraulic pressure control valve 64 of the second valve operating characteristic changing mechanism $V_2$ is determined as a current value DVIN(n) of the operational amount at Step S67. In a subsequent loop, the answer at Step S45 and the answer at Step S50 are YES and hence, the magnitude of the deviation DCAINCMD is compared again with the first feed-forward control determining value #DCAINFFO at Step S46. When the deviation DCAINCMD is larger, the processing is advanced via Steps S47 to S49 to Step S67.

Therefore, if the deviation DCAINCMD between the target cam phase CAINCMD and the actual cam phase CAIN is large when the control of the second valve operating characteristic changing mechanism $V_2$ has been started, the second valve operating characteristic changing mechanism $V_2$ is controlled substantially in the feed-forward manner by setting the current value DVIN of the control amount of the second valve operating characteristic changing control at the highest limit value #DVLMTHO which is a constant, while the above-described state is continued.

The purpose of employing the above-described control is as follows: Even if the second valve operating characteristic changing mechanism $V_2$ is controlled in the feedback manner from the beginning, the responsiveness can be ensured. However, after the cam phase has reached the target value, there is a high possibility that an overshoot is not avoided, and it is difficult to ensure a high-accuracy convergence. Therefore, the feed-forward control is employed at the beginning of the start of the control and continued for a period while the convergence is feared because of a large deviation DCAINCMD, whereby the responsiveness and the convergence can be reconciled.

If the deviation DCAINCMD is equal to or smaller than the first feed-forward control determining value #DCAINFFO from the beginning of the start of the control at Step S46, or if the deviation DCAINCMD becomes equal to or smaller than the first feed-forward control determining value #DCAINFFO during the feed-forward control at Step S46, the second valve operating characteristic changing mechanism feed-forward control flag F_VTCFF is set at "0" at Step S51, progressing to Step S52. If the last value DVIIN (n−1) of the I term of the PID feedback control is 0 at Step S52, the last value DVIIN(n−1) of the I term is determined at an I-term initial value #DVISEN at step S53.

At subsequent Step S54, the deviation DCAINCMD (a positive value; when the target cam phase is larger than the actual cam phase) is compared with the second feed-forward control determining value #DCAINFFR which is smaller than the first feed-forward control determining value #DCAINFFO. As a result, if there is a large difference between both of them, the current value DVIN(n) of the operational amount is set at the highest limit value #DVLMTH2 at Step S56, and then, the duty ratio DOUTVT of the second hydraulic pressure control valve 64 of the second valve operating characteristic changing mechanism $V_2$ is determined as the current value DVIN(n) of the operational amount at Step S67.

Likewise, the deviation DCAINCMD (a negative value; when the actual cam phase is larger than the target cam phase) is compared, at Step S55, with a third feed-forward control determining value #DCAINFFA whose absolute value is smaller than the first feed-forward control determining value #DCAINFFO. As a result, if there is a large difference between them, the current value DVIN(n) of the operational amount is set at a lowest limit value #DVLMTL1 at Step S57 and then, the duty ratio DOUTVT of the second hydraulic pressure control valve 64 of the second valve operating characteristic changing mechanism $V_2$ is determined as the current value DVIN(n) of the operational amount at Step S67.

Before the deviation DCAINCMD becomes equal to or smaller than the second and third feed-forward control determining values #DCAINFFR and #DCAINFFA at Steps S54 and S55 even after the deviation DCAINCMD becomes equal to or smaller than the first feed-forward control determining value #DCAINFFO at Step S46, the current value DVIN(n) of the operational amount is changed from the highest limit value #DVLMTHO to the highest limit value #DVLMTH2 or the lowest limit value #DVLMTL1 to continue the feed-forward control, whereby the responsiveness and convergence can be reconciled.

Figure 14:
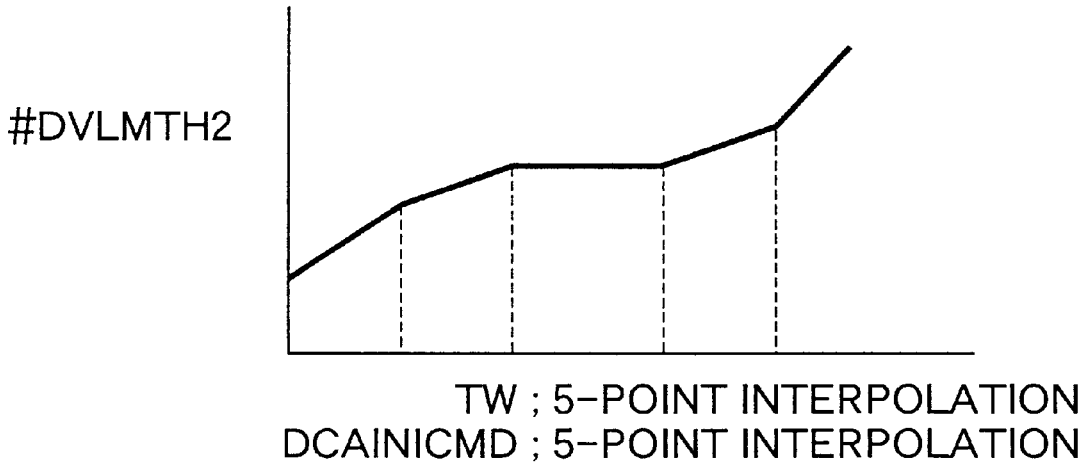

The lowest limit value #DVLMTL1 (see Step S57) is a fixed value, while the highest limit value #DVLMTH2 (see Step S56) is a variable value to increase the convergence of the feed-forward control, and is searched from a map shown in FIG. 14 based upon the cooling-water temperature detected by the cooling-water temperature sensor $S_2$ being used as a parameter or with the deviation DCAINCMD being used as a parameter.

The highest limit value #DVLMTH2 is increased in accordance with the rising of the cooling-water temperature TW for the purpose of compensating for the oil temperature rising with the rising of the cooling-water temperature TW, resulting in a decrease in hydraulic pressure, and that the coil temperature of the duty solenoid 67 is raised, resulting an increase in electric resistance, by increasing the highest limit value #DVLMTH2 determining the operational amount DVIN. The highest limit value #DVLMTH2 is increased in accordance with an increase in the deviation DCAINCMD for the purpose of increasing the operational amount DVIN to immediately converge the actual cam phase CAIN into the target cam phase CAINCMD, when the deviation DCAINCMD is large.

Only when the target cam phase CAINCMD is larger than the actual cam phase CAIN, namely, only when the second valve operating characteristic changing mechanism $V_2$ is operated in the advancing direction, the highest limit value #DVLMTH2 which is the variable value, is employed, because the reaction force received from the intake valves 10, 10 by the intake cam shaft 5 acts to change the cam phase in the retarding direction and for this reason, it is necessary to reliably advance the cam phase against such reaction force. Not only the highest limit value #DVLMTH2 but also the lowest limit value #DVLMTL1 can be changed with the cooling-water temperature TW and the deviation DCAINCMD used as parameters. If so, it is a matter of course that further accurate control is feasible.

Now, when the deviation DCAINCMD is brought to a sufficiently small value by the above-described feed-forward control, whereby both of Steps S54 and S55 are not established, a P-term gain KVP, an I-term gain KVI and a D-term gain KVD are calculated at Step S58 and then, a P term DVPIN, an I term DVIIN and a D term DVDIN are calculated at Step S59 according to

DVPIN←KVP*DCAINCMD

DVIIN(n)←*KVI*DCAINCMD+DCAINCMD (n−1)

DVDIN←KVD*DCANIN in order to carry out the PID feedback control.

At subsequent Steps S60 to S63, the over-growth of the I term DVIIN is inhibited to reduce the convergence by carrying out the limit control of the I term DVIIN. More specifically, if the current value DVIIN(n) of the I term exceeds the highest limit value #DVLMTH1 at Step S60, the highest limit value #DVLMTH1 is determined as the current value DVIIN(n) of the I term at Step S62. If the current value DVIIN(n) of the I term is smaller than the lowest limit value #DVLMTL at Step S61, the lowest limit value #DVLMTL1 is determined as the current value DVIIN(n) of the I term at Step S63.

If the current value DVIIN(n) of the I term is between the highest limit value #DVLMTH1 and the lowest limit value #DVLMTL at Steps S60 and S61, the current value DVIN(n) of the operational amount of the PID feedback control is calculated as a sum of the P term DVPIN, the I term DVIIN and the D term DVDIN at Step S64.

Then, at Steps S65, S66, S56 and S57, the limit processing of the current value DVIN of the operational amount is carried out. More specifically, if the current value DVIN(n) of the operational amount exceeds the highest limit value #DVLMTH at Step S65, the highest limit value #DVLMTH is determined as the current value DVIN(n) of the operational amount at Step S56. If the current value DVIN(n) of the operational amount is smaller than the lowest limit value #DVLMTL at Step S66, the lowest limit value #DVLMTL1 is determined as the current value DVIN(n) of the operational amount at Step S57. The operational amount DVIN is brought to the duty ratio DOUTVT of the second hydraulic pressure control valve 64 at Step S67, whereby the second valve operating characteristic changing mechanism $V_2$ is feedback-controlled to converge the deviation DCAINCMD between the target cam phase CAINCMD and the actual cam phase CAIN to 0.

When the second valve operating characteristic changing mechanism $V_2$ is in failure, whereby the second valve operating characteristic changing mechanism failure flag F_VTCNG has been set at "1" at Step S41, the current value DVIN(n) is set at a failure-restoring preset value #DVLMTM corresponding to the duty ratio of the duty solenoid 67, for example, equal to 50% at Step S69 via Step S68, and a failure-restoring timer TMVTCNG (e.g., 3 sec) is set at subsequent Step S70. From the next loop, the answer at Step S68 is NO for the period until the counting of the failure-restoring timer TMVTCNG is completed. Therefore, the current value DVIN(n) is set at "0" at Step S71.

The above-described control ensures that when the second valve operating characteristic changing mechanism $V_2$ fails, the second hydraulic pressure control valve 64 can be brought into a most-retarded state and moreover, operated instantaneously into the advancing direction at a predetermined time interval. As a result, when a failure is generated due to dust, or when a failure is determined instantaneously by pulsation of the hydraulic pressure circuit or the like, the second valve operating characteristic changing mechanism $V_2$ or the second hydraulic pressure control valve 64 can be restored automatically to a normal state.

When the second valve operating characteristic changing mechanism control permitting flag F_VTC has been set at "0" at Step S42 to prohibit the operation of the second valve operating characteristic changing mechanism $V_2$, the second valve operating characteristic changing mechanism feed-forward control flag F VTCFF is set at "0" at Step S72, and the current value DVIIN(n) of the I term is set at "0" at Step S73, progressing to Step S74.

If the first valve operating characteristic changing mechanism control permitting flag F_VTEC is at "0" (the low-speed valve timing) at Step S74, the current value DVIN(n) of the operational amount is fixed at a preset value #DVLMTLOL (corresponding to the duty ratio of 10%) suitable for the low-speed valve timing at Step S75. On the other hand, if the first valve operating characteristic changing mechanism control permitting flag F_VTEC is at "1" (the high-speed valve timing) at Step S74, the current value DVIN(n) of the operational amount is fixed at a preset value #DVLMTLOH (corresponding to the duty ratio of 50%) suitable for the high-speed valve timing at Step S76.

The preset value #DVLMTLOL (corresponding to the duty ratio of 10%) suitable for the low-speed valve timing corresponds to a value immediately before the locking pin 47 of the second valve operating characteristic changing mechanism $V_2$ is moved out of the locking bore $\mathbf{7}_3$. The preset value #DVLMTLOH (corresponding to the duty ratio of 50%) suitable for the high-speed valve timing corresponds to a value at which the spool 66 of the second hydraulic pressure control valve 64 is maintained in the neutral position.

In this way, when the operation of the second valve operating characteristic changing mechanism $V_2$ is prohibited to fix the cam phase in the most-retarded state, the duty ratio of the second hydraulic pressure 64 is set at a value (e.g., 50%) suitable for the high-speed valve timing, whereby the spool 66 of the second hydraulic pressure control valve 64 is maintained in the neutral position, only when the high-speed valve timing has been selected by the first valve operating characteristic changing mechanism $V_1$. Thus, it is possible to prevent the leakage of hydraulic pressure in the second valve operating characteristic changing mechanism $V_2$ and to ensure the establishment of the high-speed timing by the first valve operating characteristic changing mechanism $V_1$.

The first valve operating characteristic changing mechanism $V_1$ is not limited to that described in the embodiment, and any of mechanisms of various structures may be employed, if it can change the valve operating characteristic at least by hydraulic pressure. In addition, the most-displaced basic position of the second operating characteristic changing mechanism $V_2$ has been described as the most-retarded state in the embodiment, but may be a most-advanced state As discussed above, when the high-speed valve timing is established by supplying the hydraulic pressure from the oil pump through the first hydraulic pressure control valve to the cam switching type first valve operating characteristic changing mechanism, and the cam phase is set in the most-displaced basic position by the cam-phase changing type second valve operating characteristic changing mechanism, the second hydraulic pressure control valve cuts off the hydraulic pressure supplied from the oil pump to close the advancing chamber and the retarding chamber in the second valve operating characteristic changing mechanism, thereby maintaining the cam phase in the most-displaced basic position. Thus, it is possible to set the cam phase in the most-displaced basic position without consumption of the hydraulic pressure supplied from the oil pump by the leakage in the second valve operating characteristic changing mechanism, and to ensure the hydraulic pressure enough for the first valve operating characteristic changing mechanism to establish the high-speed valve timing with the minimum capacity of the oil pump, thereby guaranteeing the reliability of the valve operating characteristic changing control. Moreover, the second hydraulic pressure control valve is maintained in the neutral position in which it closes the advancing chamber and the retarding chamber in the second valve operating characteristic changing mechanism. Therefore, in changing the cam phase from the most-displaced basic position to an opposite position, the hydraulic pressure supplied to the advancing chamber or the retarding chamber in the second valve operating characteristic changing mechanism can be immediately risen to enhance the responsiveness.

Although the embodiment of the present invention has been described, it will be understood that the present invention is not limited to the above-described embodiment, and various modifications may be made without departing from the subject matter of the present invention.

What is claimed is:

1. A valve operating control system for an internal combustion engine having a low-speed cam and a high-speed cam, comprising an oil pump;

a cam switching type, first valve operating characteristic changing mechanism;

a first hydraulic pressure control valve, wherein hydraulic pressure is supplied from said oil pump through said first hydraulic pressure control valve to said first valve operating characteristic changing mechanism;

a cam-phase changing type, second valve operating characteristic changing mechanism;

a second hydraulic pressure control valve, wherein the hydraulic pressure is supplied from said oil pump through said second hydraulic pressure control valve to said second valve operating characteristic changing mechanism;

wherein said first valve operating characteristic changing mechanism selects said low-speed cam to establish a low-speed valve timing, when no hydraulic pressure is supplied from said first hydraulic pressure control valve, and selects said high-speed cam to establish a high-speed valve timing, when the hydraulic pressure is supplied, wherein said second valve operating characteristic changing mechanism includes an advancing chamber and a retarding chamber, said second valve operating characteristic changing mechanism changing the cam phase, when the hydraulic pressure is supplied selectively to said advancing chamber or said retarding chamber, and wherein when said first valve operating characteristic changing mechanism establishes the high-speed valve timing and said second valve operating characteristic changing mechanism sets the cam phase in a most-displaced basic position, said second hydraulic pressure control valve closes both of said advancing chamber and said retarding chamber, and is maintained in a neutral position in which it cuts off hydraulic pressure supplied from said oil pump.

* * * * *